US006123632A

United States Patent [19]

Feeney et al.

[11] Patent Number: 6,123,632

[45] Date of Patent: Sep. 26, 2000

[54] GAME BALL WITH IMPROVED MOISTURE RESISTANCE

[75] Inventors: Brian Feeney, Enfield, Conn.; Chris Waldeck, Westfield, Mass.

[73] Assignee: Spalding Sports Worldwide, Inc., Chicopee, Mass.

[21] Appl. No.: 09/184,369

[22] Filed: Nov. 2, 1998

[51] Int. Cl.[7] ..... B05D 1/00

[52] U.S. Cl. ..... 473/596; 473/599

[58] Field of Search ..... 473/569, 598–610

[56] References Cited

U.S. PATENT DOCUMENTS

| | | | |
|---|---|---|---|
| 3,708,333 | 1/1973 | Carlson | 428/220 |
| 4,701,269 | 10/1987 | Bay et al. . | |
| 4,755,187 | 7/1988 | Friese et al. . | |
| 5,069,935 | 12/1991 | Walters | 473/599 |
| 5,204,088 | 4/1993 | Noebel et al. . | |
| 5,409,527 | 4/1995 | Baker et al. . | |
| 5,534,035 | 7/1996 | Allen et al. . | |
| 5,536,304 | 7/1996 | Coppens et al. . | |
| 5,702,490 | 12/1997 | Kneip et al. . | |
| 5,752,890 | 5/1998 | Shishido et al. | 473/599 |
| 5,820,488 | 10/1998 | Sullivan et al. | 473/378 |

FOREIGN PATENT DOCUMENTS

| | | | |
|---|---|---|---|
| 230137 | 11/1985 | German Dem. Rep. . | |
| 1799884 | 3/1993 | U.S.S.R. . | |
| 1021424 | 3/1966 | United Kingdom | 273/225 |

*Primary Examiner*—Jeanette Chapman
*Assistant Examiner*—Mitra Aryanpour

[57] ABSTRACT

A game ball with resistance to liquid moisture, wherein the cover of the game ball is made of leather. The leather of the game ball cover has water resistance properties imparted by the tanning process. In a game ball of the invention having a bladder and a cover, the game ball may optionally include a lining situated between the bladder and the cover, with the lining optionally having water resistance properties.

5 Claims, 3 Drawing Sheets

GAME BALL WITH IMPROVED MOISTURE RESISTANCE

FIELD OF THE INVENTION

The present invention relates generally to game balls with improved moisture resistance. In particular, the invention relates to game balls with leather covers which provide moisture resistance through prolonged or repeated exposure to liquid moisture.

BACKGROUND OF THE INVENTION

Game balls are commonly exposed to moisture in the liquid state during the course of normal use. For example, a game bell may commonly come in contact with the perspiration of a player as the ball is handled, and to dew, rain, and snow on the playing surface and surrounding area. It is even possible for a ball to become immersed in a puddle or other body of water during the course of normal play.

When a game ball comes in contact with water some is likely to be absorbed by the leather cover. Direct and obvious negative results of the cover absorbing water include an increase in the weight of the ball, a deterioration in ball handling characteristics due to changes in surface texture, feel, and grip, and a darkening of the color of the leather cover. It will be appreciated that the weight and handling characteristics of a game ball are of particular importance at any level of athletic play and that preserving the original dry characteristics of a ball even in adverse weather or poor field conditions is of great importance.

It is well known that leather softens when wet and becomes noticeably less durable. In particular, wet leather is less resistant to wear from surface abrasion and cuts and gouges from contact with sharp objects. As leather dries it typically shrinks and becomes harder and stiffer than prior to wetting. In a game ball this may lead to cracking of the leather, or even tearing in areas of high stress, such as at stitching points between the cover panels of the ball. Repeated cycles of wetting and drying can exacerbate the problems of shrinking, cracking and hardening of the leather cover. Therefore, It will also be recognized by the practitioner that the overall durability of a ball and its resistance to absorbing moisture in the liquid state are of particular importance in prolonging the useful life and preserving the structure and playability of the bell.

Various materials are known in the art for providing protection against wetting of the leather cover of a game ball. These materials are primarily intended for treating the outer surface of the cover to impart a water repellent finish. Waxes and wax-like substances, such as SIMONZ wax, commercially available from S.C. Johnson Wax Company, Racine, Wis., and a specialty leather water-proofing wax-like material known as SNO-SEAL, commercially available from ATSKO/Sno-Seal, Inc., Orangeburg, S.C. have been applied to leather game ball covers to impart a water repellant finish. Other materials, such as the polyfluoroalkyl materials disclosed in U.S. Pat. No. 5,069,935, and the silica materials disclosed in U.S. Pat. No. 5,204,088, have also been used on game ball covers. These surface treatment materials all have the tendency to wear away during the course of normal game ball use, thus the effectiveness of the water resistant finish may be greatly diminished or even totally lost. In addition, some materials, such as the silicone-based water resistant materials, may even wash-off under wet playing conditions.

Further drawbacks of treating the game ball cover with these materials include significantly altering the color of the leather to which the materials are applied with the leather typically being darkened through their application. More importantly, leather covered game balls which have been treated with these materials have their "feel" significantly altered. For game play, maintaining the normal texture, feel and grip of the game ball is of significant importance. Applying materials which cause a ball to become slippery, sticky, or in the case of some waxes, just generally unpleasant to handle, can significantly alter the normal course of play.

The leather tanning and hide industry has developed tanning techniques for improving the water-resistance properties of the leather such as one process known as "fat liquoring". The process disclosed in U.S. Pat. No. 4,755,187 involves the use of a sulfosuccinic monoester in the tanning and treating chemicals to impart the desired water-resistance properties to the finished hides. It is believed that other materials and processes are used by the leather tanning industry for imparting water resistance to leather, but that these materials and techniques are held as trade secrets.

SUMMARY OF THE INVENTION

An object of the present invention is to provide a game ball with a leather cover having resistance to liquid moisture.

Another object of the present invention is to provide a game ball which retains resistance to liquid moisture through repeated exposure to liquid moisture.

A further object of the invention is to provide a game ball which retains resistance to liquid moisture through prolonged exposure to liquid moisture.

Other objects of the present invention will in part be obvious and in part pointed out in more detail hereinafter.

These and related objects are achieved in one embodiment of the invention by providing a game ball having a leather cover with improved resistance to absorption of water. The leather itself is prepared by a tanning process and using tanning materials which provide the leather with the desired resistance to water. The inventors have found that the water resistance properties imparted in tanning are longer lasting and provide better water resistance than the surface treatments conventionally used on game balls. The water resistance properties imparted by tanning are distributed throughout the leather and are associated with each fiber of the leather. Because of the distribution of the water resistance properties throughout the leather, water which contacts the leather is typically unable to find an untreated area in which to be absorbed. Furthermore, because the water resistance properties are distributed throughout the leather and the properties are not readily susceptible to wearing or washing away as are the water resistance treatments applied to the surface of a game ball. Conventional surface treatments for water resistance appear to be of only temporary effectiveness by comparison.

It is envisioned that any game ball can advantageously be constructed according to the present invention, including, but not limited to those game balls constructed with an outer cover and inner bladder and optionally, a lining disposed between the cover and bladder. Such game balls Include, but are not limited to American-style footballs, rugby balls, soccer balls, volley balls, and basket balls. It is further envisioned that other leather covered balls may benefit from the present invention, including those balls which have a construction including a cover and a core, such as baseballs and softballs.

DETAILED DESCRIPTION OF THE INVENTION

For clarity of description and ease of understanding, the invention will be described in connection with FIGS. 1, 2 and 3 wherein like structures and features in the Figures are identified with the same numbers. It will be understood that FIG. 3 relates to an American-style football, but other game balls with leather covers can advantageously employ the various features of the present invention.

Figure 1:
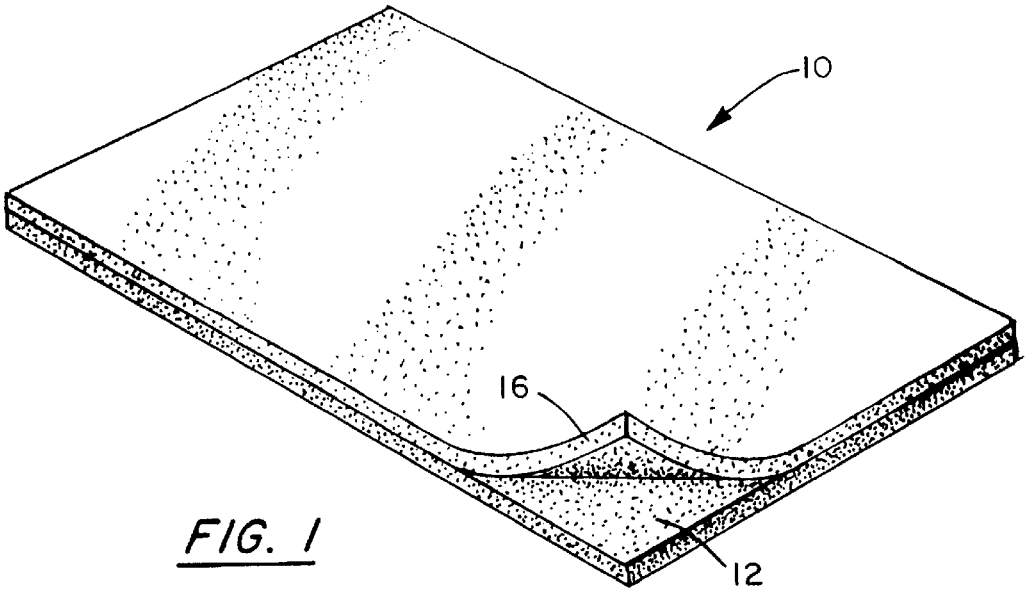
FIG. 1 is a magnified view, partially broken away and partially sectional, of a first embodiment of a game ball incorporating the features of the present invention.

FIG. 1 shows a portion of a game ball 10 made according to the present invention. The game ball 10 comprises a layer of bladder material 12 and an overlayer of a covering material 16. In the structure of a typical American football the bladder material 12 is commonly made of a highly durable, stretchable, Inflatable material such as butyl rubber, or a polyurethane material. It will be understood that any material which possesses properties and performance qualities similar to butyl rubber or polyurethane may be used as the material of the bladder.

The cover material 16 is formed of leather which has been tanned by a process and using chemicals intended to impart water-resistance properties to the finished leather. The leather used in the cover of the ball may be of the type which is traditionally used for such a ball. For example, in an American-style football, the leather would traditionally be a cowhide leather. Similarly, a baseball would also traditionally have a cover made from cowhide leather. However, the actual leather used in the cover of a ball need not be of the traditional type for a particular type of game ball. For the purposes of this invention it is more important that the leather used possess the necessary performance properties including sufficient resistance to water.

Figure 2:
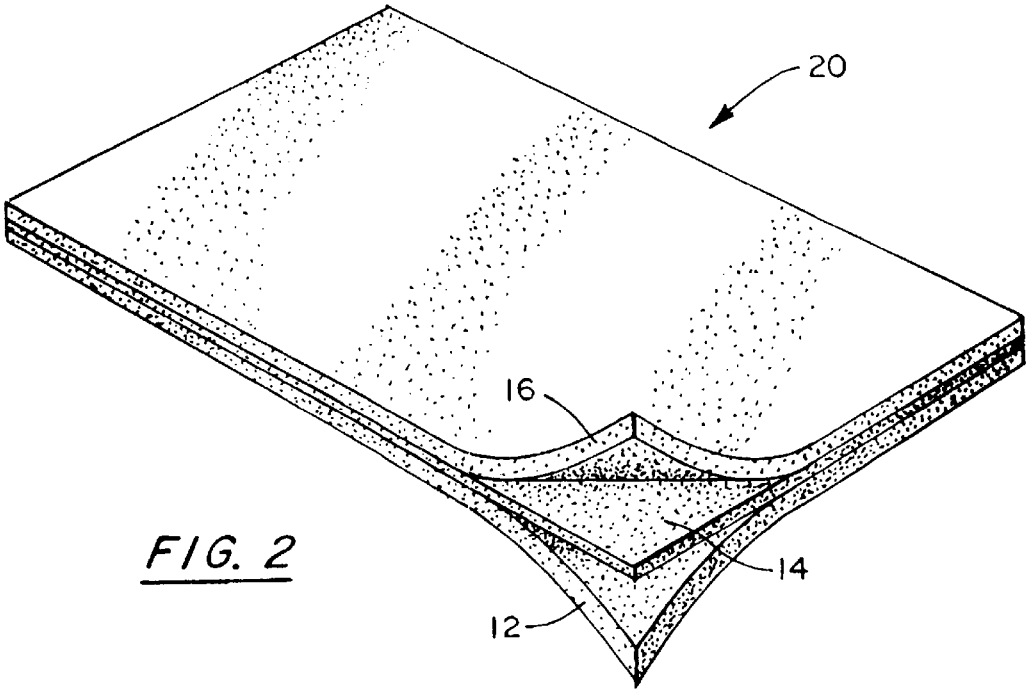
FIG. 2 is a magnified view, partially broken away and partially sectional, of a a second embodiment of a game ball incorporating the features of the present invention which include a lining in the structure of the game ball.

In FIG. 2 the game ball 20 incorporating further features of the present invention is shown. In FIG. 2 a lining 14 is located immediately over the bladder 12, and immediately over the lining, the leather cover 16 is situated. A lining is employed in the structure of some game balls to help the ball retain the proper shape and to provide additional strength and mechanical reinforcing to the cover material. Significant amounts of stress and strain are imposed on the cover by the forces generated by the inflated bladder. Typically, the ball is inflated to about 12–15 psi and much of this force is imposed on the leather cover. Overstress conditions can be imposed through kicking, bouncing, and the rough handling that a ball typically receives while in play. The lining helps the ball maintain shape and structural integrity in the face of these conditions.

Figure 3:
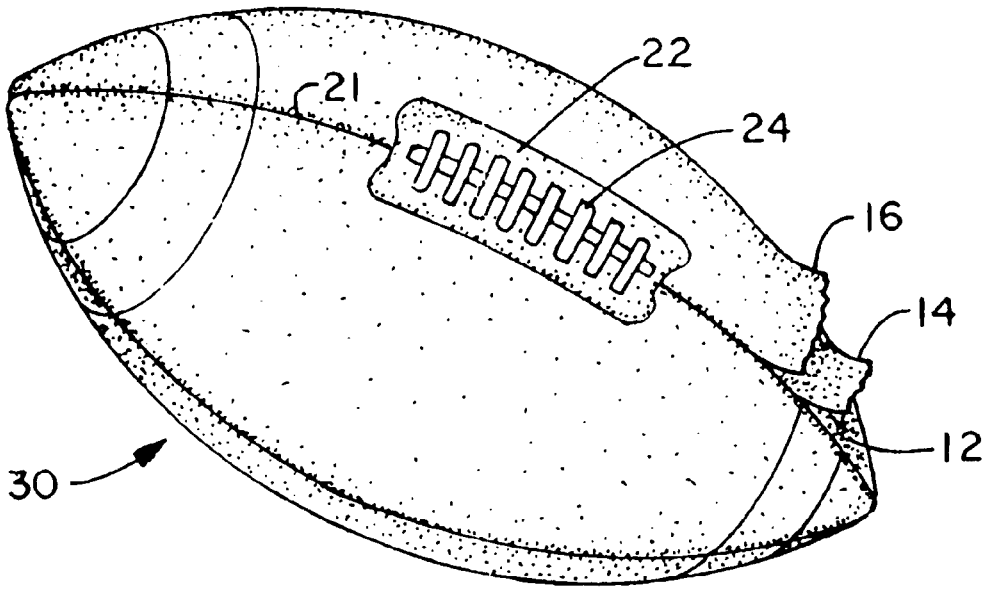
FIG. 3 is a plan view of an American football, partially broken away and partially in sectional view, incorporating the features of the present invention.

FIG. 3 shows an American-style football 30 constructed according to the present invention. The football includes a bladder 12 which Is covered with a lining 14, which is enclosed within the leather cover 16. The football 30 illustrated in FIG. 3 further shows a seam 21 where panels of the leather cover of the bell meet and are sewn together. Apertures 22 formed in the cover of the ball allow the passage of lacings 24 which seal an opening in the cover through which the bladder and liner are inserted.

The leather used in the present invention is a tanned leather which has substantial water resistance properties imparted by the tanning process and the particular tanning chemicals used in the process. The tanning process imparts water resistance throughout the leather, with all the fibers of the leather acquiring water resistance properties. The tanned-in nature of the water resistance properties makes the leather less likely to absorb water than those leathers which have a topical water resistance treatment, particularly after prolonged or multiple exposures to wet conditions.

The water resistance properties of different leathers can be compared in terms of the amount of water absorbed over a period of time by a given weight of a sample of leather. For the purposes of this application water resistance is expressed as a ratio of the combined weight of a leather sample and the water absorbed after a specific period of immersion In water to the original dry weight of the leather sample It will be appreciated that a sample which has a low ratio, that is a ratio approaching 1:1, has better water resistance than a sample with a higher ratio.

To achieve the goals of the present invention it has been discovered that the leather used in a game ball should have a ratio of the combined weight of a leather sample and the water absorbed after immersion in water for 45 minutes to the original dry weight of the leather sample in the range of 1.01:1 to 1.5:1. Preferably, the ratio should be in the range of 1.02:1 to 1.3:1, and most preferably, 1.05:1 to 1.2:1. Similarly, a football made according to the invention should have a ratio of 1.2:1 or less after 45 minutes of immersion in water.

When comparing leathers for use in this invention it will be appreciated that care should be taken to provide samples having similar dimensions and uniform shapes in order to make a comparison of materials as direct as possible. A sample which is irregularly shaped with an extensive edge surface may absorb water much differently than samples having a more uniform size and shape. A sample of grossly dissimilar thickness may also be of consequence in making direct comparison with other samples of leather. One aspect of having grossly dissimilar thicknesses of leather is that on immersion in water a thicker sample may take a considerably longer period for full saturation of the sample with water to occur.

Leather meeting the requirements of the invention may be commercially obtained from a leather supplier such as Pittard's, Inc., Leeds, England, or Bali Leathers, Inc., Johnstown, N.Y. Examples of such leathers having water proofing or water resistance properties distributed throughout the entire structure of the leather include leather available from Pittards, Inc. under the designations Pittard's WR2000TC and WR100 leather.

Leather tanned using the Pittard's process and chemicals results in a permanent tanned-in water resistance which permeates the leather and imparts water resistance properties to all the fibers of the leather. Leather which is treated in this way is highly resistant to water in the liquid form, but water vapor passes through the leather rather freely.

The lining used in one embodiment of the present invention may be one or more plies of a woven or a non-woven fabric-like material. The density of the fibers in the material can vary greatly from a low density, open mesh or scrim material to a material having a greater fiber density with an appearance and characteristics which are cloth-like.

Traditionally, the lining of a game ball was made from natural fibers such as cotton or linen, but synthetic or man-made fibers may also be employed. Such fibers include polyester, nylon and even glass fibers. Generally it is preferred to use fibers which are resistant to water. For improved water resistance the lining or the fibers which comprise the lining may be coated or encapsulated with a suitable resin or plastic. Such materials include vinyls, epoxies and urethanes. It will be appreciated that such a coating will have particular use in conjunction with fibers having no or low water resistance, Including such natural fibers as cotton and linen. However, the coating may be applied to linings made of other fibers, including polyester, nylon and glass fibers.

The lining may optionally be formed from a sheet-like material, such as a continuous monolithic sheet of a resin or other plastic material. Suitable materials include vinyls, polyolefins, polyesters, and urethanes. The sheet-like materials may preferably be non-porous and may optionally be reinforced with fibers. Suitable fibers would include fibers made of cotton, linen, polyesters, polyolefins, nylons, and glass fibers. The fibers may be present in the form of aligned or randomly dispersed fibers, and also in the form of fibers forming a non-woven or a woven fabric-like material as described above. In addition, the reinforcing fibers found in the sheet-like material may be used in the form of a single layer or multiple layers.

When the lining is in the form of at least two piles of a continuous, monolithic, non-porous sheet, as described herein, additional benefits may be realized in the present invention. Wherein said a continuous sheet when pressed tightly against the backside of a leather cover by the inflated bladder forms a "gasket" which seals the back side of the cover against infiltration by water. This is of particular interest in preventing or reduces the migration of water which may enter a ball through the seams and lacing holes and other openings commonly found in the cover of a ball and attempt to seep between the cover and the bladder of the ball.

It is preferred that the lining of the ball have water resistance expressed as a ratio of the weight of the sample plus absorbed water to dry weight of a sample of the lining in the range of 1.1:1 or less after 45 minutes of immersion in a water bath at about 70° F., The water resistance of samples of leather and entire game balls was explored in a series of tests. In a first set of tests samples of leather cover material were cut from a WILSON NFL model football, commercially available from Wilson Sporting Goods Co., Chicago, Ill., and a RAWLINGS NCAA ST-5 model football having what is believed to be surface applied water-resistant properties, commercially available from Rawlings, St. Louis, Mo. A sample of the PITTARD'S WR2000TC leather as used in game balls of the present invention, was also cut (designated as Example 1). All the leather samples were cut into swatches approximately 1.5"×5" and the original dry (pre-immersion) weight of each sample was recorded.

The sample pieces were then completely immersed in water at about 70° F. and removed at timed intervals for weighing, Excess water was wiped off the samples to obtain an accurate weight of the sample and the water absorbed by the sample. Once weighed, the samples were immersed in water again until the next time interval for weighing.

Once a total immersion time of 45 minutes was reached the samples were removed from the water, excess water wiped off and the samples weighed again, thus completing one full cycle of testing. The samples were then allowed to dry by a combination of air drying under ambient conditions and warm oven drying. The dried weight of the samples were then recorded. In total, the samples were subjected to six cycles of immersion and drying. The weight of each leather sample is reported in Table 1 below for the first, second and sixth cycles of testing.

TABLE 1

WATER UPTAKE OF LEATHER MATERIAL
WEIGHT OF LEATHER SAMPLES EXPRESSED IN GRAMS

| Time Immersed | Cycle Number | | |
|---|---|---|---|
| (In minutes) | 1 | 2 | 6 |
| | WILSON NFL - Thickness Of Sample (mm) 1.74 | | |
| 0 | 7.65 | 7.64 | 7.47 |
| 1 | 9.97 | 9.69 | 8.30 |
| 5 | 11.94 | 11.82 | 9.64 |
| 10 | 12.47 | 12.45 | 10.63 |
| 20 | 12.76 | 12.70 | 11.27 |
| 30 | 12.84 | 12.80 | 11.60 |
| 45 | 12.95 | 12.85 | 11.84 |
| | RAWLINGS ST-5 - Thickness Of Sample (mm) 1.76 | | |
| 0 | 6.91 | 6.90 | 6.76 |
| 1 | 8.74 | 8.32 | 7.23 |
| 5 | 10.72 | 11.06 | 8.49 |
| 10 | 11.79 | 11.94 | 10.02 |
| 20 | 12.23 | 12.16 | 11.16 |
| 30 | 12.38 | 12.25 | 11.48 |
| 45 | 12.56 | 12.28 | 11.64 |
| | EXAMPLE 1 - Thickness Of Sample (mm) 2.15 | | |
| 0 | 8.44 | 8.22 | 8.12 |
| 1 | 8.59 | 8.44 | 8.33 |
| 5 | 8.78 | 8.70 | 8.60 |
| 10 | 8.84 | 8.91 | 8.85 |
| 20 | 9.18 | 9.24 | 9.14 |
| 30 | 9.37 | 9.47 | 9.37 |
| 45 | 9.57 | 9.68 | 9.59 |

It Is interesting to note that the dry weight reported for the samples after an immersion and drying cycle could be less than the initial dry weight of the sample. It is believed that the process of soaking the leather in water may cause leaching or washing away of some of the oils, salts and other materials commonly found in a new piece of leather. Hence, upon drying, the leather sample no longer contained the materials which removed by soaking in water and the weight of the samples were therefore less than the original dry weight.

From the data obtained for Table 1, calculations were made to determine the ratio of the combined weight of the sample and absorbed water to the original dry weight of the samples. The calculated ratios are reported below in Table 2.

TABLE 2

RATIO - COMBINED WEIGHT OF LEATHER AND ABSORBED WATER: ORIGINAL DRY WEIGHT OF LEATHER SAMPLE

| Time Immersed (in minutes) | Cycle Number 1 | 2 | 6 |
|---|---|---|---|
| | WILSON NFL | | |
| 1 | 1.30 | 1.27 | 1.11 |
| 5 | 1.56 | 1.55 | 1.29 |
| 10 | 1.63 | 1.63 | 1.42 |
| 20 | 1.67 | 1.66 | 1.51 |
| 30 | 1.68 | 1.68 | 1.55 |
| 45 | 1.69 | 1.68 | 1.59 |
| | RAWLINGS ST-5 | | |
| 1 | 1.26 | 1.21 | 1.07 |
| 5 | 1.55 | 1.60 | 1.26 |
| 10 | 1.71 | 1.73 | 1.48 |
| 20 | 1.77 | 1.76 | 1.65 |
| 30 | 1.79 | 1.78 | 1.70 |
| 45 | 1.82 | 1.78 | 1.72 |
| | EXAMPLE 1 | | |
| 1 | 1.02 | 1.03 | 1.03 |
| 5 | 1.04 | 1.06 | 1.06 |
| 10 | 1.06 | 1.08 | 1.09 |
| 20 | 1.09 | 1.12 | 1.13 |
| 30 | 1.11 | 1.15 | 1.15 |
| 45 | 1.13 | 1.18 | 1.18 |

Figure 4:
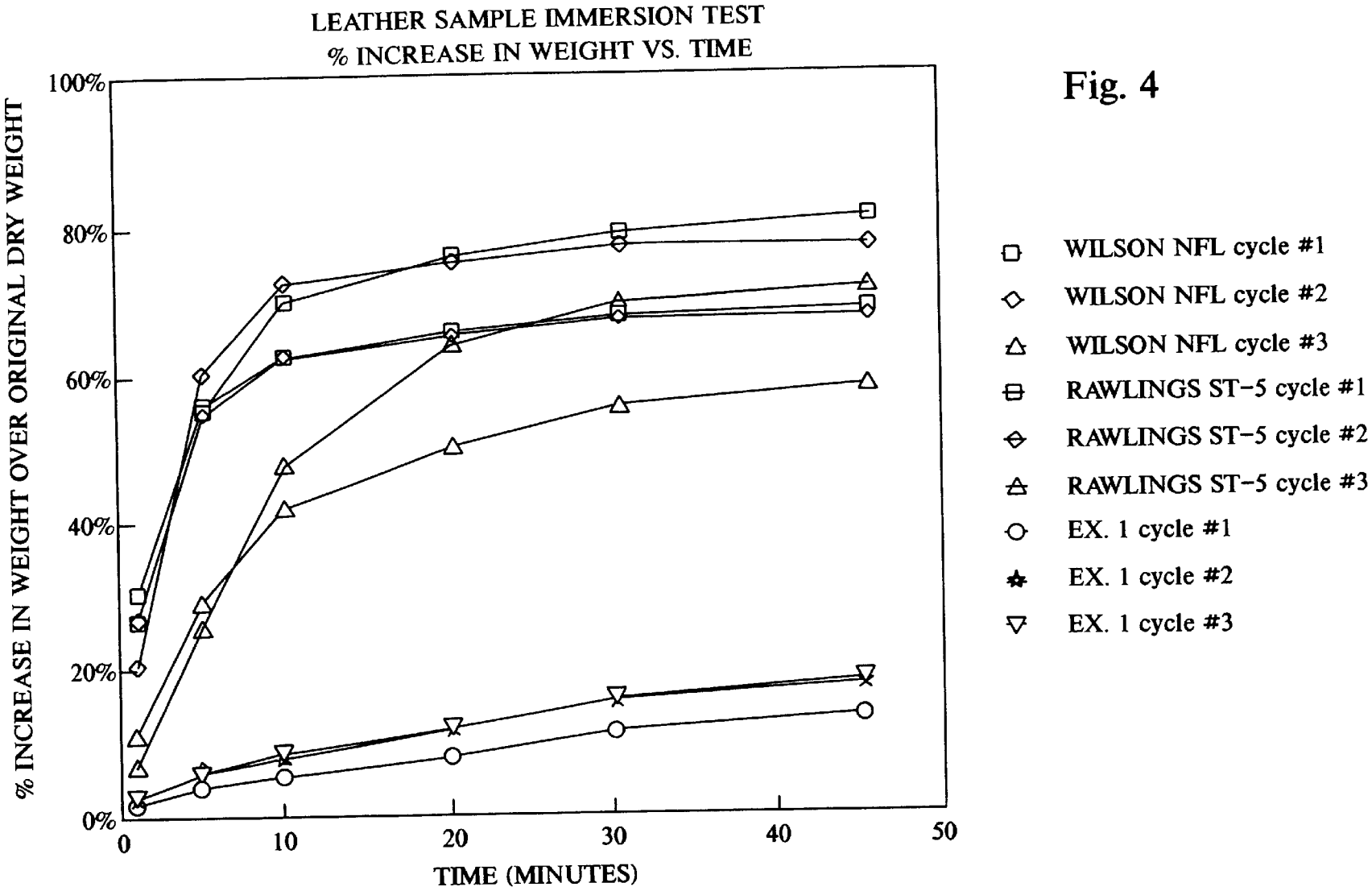
FIG. 4 is a graph showing the comparative water resistance performance of leather samples from commercially available footballs and the leather used in a football of the present invention.

It can be seen from the ratios reported in Table 2 that the leather of Example 1 consistently had the lowest water uptake of all of the leather samples. This difference in performance can be seen to great advantage in the graph presented in FIG. 4, wherein water resistance is expressed in terms of a percentage increase in weight over the initial dry weight of the sample.

The testing procedure used for determining the water resistance of footballs is similar to that used in testing the leather samples as reported in Tables 1 and 2 above. Here two entire WILSON NFL model footballs (designated as WILSON NFL "A" and "B") and two RAWLINGS NCAA ST-5 model footballs with water resistance properties (designated RAWLINGS ST-5 "A" and "B"), were compared through testing to a football made according to the present invention. The ball of the Invention (designated Example 2) had a cover made of PITTARD'S WR2000TC leather and a lining of a coated mesh of polyester fibers.

All balls used in this test were inflated to about 14 psi and were held under the surface of the water to obtain full immersion. Each cycle of the test included a total of up to 120 minutes of immersion in 70° F. water, as shown in the tables. Comparative Testing of the balls consisted of three complete cycles of immersion, weighing, and drying.

The absorbed water weight gains for each ball are reported below in Table 3.

TABLE 3

WATER UPTAKE OF LEATHER FOOTBALL INCREASE IN BALL WEIGHT EXPRESSED IN GRAMS

| Time Immersed (in minutes) | Cycle Number 1 | 2 | 3 |
|---|---|---|---|
| | WILSON NFL - A | | |
| 0 | 0.0 | 0.0 | 0.0 |
| 15 | 83.9 | 79.1 | 89.4 |
| 30 | 126.7 | 115.3 | 129.2 |
| 45 | 137.9 | 131.0 | 135.4 |
| 60 | 143.8 | 138.2 | 141.3 |
| 75 | 148.3 | 143.3 | 143.0 |
| 90 | 151.3 | 146.3 | 144.3 |
| 105 | — | 146.8 | 145.6 |
| 120 | — | 149.7 | 146.8 |
| | WILSON NFL - B | | |
| 0 | 0.0 | 0.0 | 0.0 |
| 15 | 123.1 | 131.2 | 124.6 |
| 30 | 140.2 | 141.2 | 133.9 |
| 45 | 146.0 | 145.0 | 136.3 |
| 60 | 150.8 | 147.5 | 138.4 |
| 75 | 153.6 | 149.2 | 140.7 |
| 90 | 155.7 | 150.7 | 141.8 |
| 105 | 158.0 | 151.5 | 142.7 |
| 120 | 159.5 | 152.5 | 144.1 |
| | RAWLINGS ST-5 - A | | |
| 0 | 0.0 | 0.0 | 0.0 |
| 15 | 11.9 | 75.1 | 77.0 |
| 30 | 26.1 | 98.5 | 114.3 |
| 45 | 49.6 | 112.8 | 127.0 |
| 60 | 73.5 | 120.2 | 130.5 |
| 75 | 89.0 | 123.9 | 132.1 |
| 90 | 103.5 | 128.7 | 134.9 |
| 105 | 114.5 | — | 135.9 |
| 120 | 123.4 | — | 137.7 |
| | RAWLINGS ST-5 - B | | |
| 0 | 0.0 | 0.0 | 0.0 |
| 15 | 10.5 | 57.5 | 61.9 |
| 30 | 31.0 | 78.6 | 95.8 |
| 45 | 46.5 | 91.8 | 109.6 |
| 60 | 60.3 | 106.4 | 119.5 |
| 75 | 74.8 | 116.1 | 123.2 |
| 90 | 89.6 | 118.4 | 126.2 |
| 105 | 98.2 | — | 129.4 |
| 120 | 107.9 | — | 133.5 |
| | EXAMPLE 2 | | |
| 0 | 0.0 | 0.0 | 0.0 |
| 15 | 54.7 | 35.7 | 30.7 |
| 30 | 84.8 | 75.7 | 56.0 |
| 45 | 100.8 | 96.8 | 71.3 |
| 60 | 110.5 | 106.5 | 82.1 |
| 75 | 118.2 | 113.7 | 89.1 |
| 90 | 122.3 | 119.8 | 93.4 |
| 105 | — | — | 96.8 |
| 120 | — | — | 99.6 |

It will be noted that in testing the footballs some were subjected to 90 minutes of immersion while other balls were subject to 120 minutes of immersion. At the time the testing was conducted 90 minutes of immersion was believed to be sufficient to achieve full saturation of the bell. However, during the testing it was decided to extend some of the test cycles to 120 minutes of immersion to obtain more test data.

The calculated ratio of the combined weight of the football and absorbed water for each time period to the original dry weight of the football are set forth In Table 4.

TABLE 4

RATIO - COMBINED WEIGHT OF BALL AND ABSORBED WATER: ORIGINAL DRY WEIGHT OF FOOTBALL

| Time Immersed (in minutes) | Cycle Number 1 | 2 | 3 |
|---|---|---|---|
| | WILSON NFL - A | | |
| 0 | 1.00 | 1.00 | 1.00 |
| 15 | 1.21 | 1.20 | 1.22 |
| 30 | 1.31 | 1.29 | 1.31 |
| 45 | 1.34 | 1.32 | 1.33 |
| 60 | 1.36 | 1.34 | 1.34 |
| 75 | 1.37 | 1.35 | 1.35 |
| 90 | 1.37 | 1.36 | 1.35 |
| 105 | — | 1.36 | 1.35 |
| 120 | — | 1.37 | 1.36 |
| | WILSON NFL - B | | |
| 0 | 1.00 | 1.00 | 1.00 |
| 15 | 1.32 | 1.33 | 1.31 |
| 30 | 1.36 | 1.36 | 1.33 |
| 45 | 1.37 | 1.37 | 1.34 |
| 60 | 1.39 | 1.38 | 1.34 |
| 75 | 1.39 | 1.38 | 1.35 |
| 90 | 1.40 | 1.38 | 1.35 |
| 105 | 1.40 | 1.39 | 1.35 |
| 120 | 1.41 | 1.39 | 1.36 |
| | RAWLINGS ST-5 - A | | |
| 0 | 1.00 | 1.00 | 1.00 |
| 15 | 1.03 | 1.13 | 1.19 |
| 30 | 1.06 | 1.24 | 1.28 |
| 45 | 1.12 | 1.27 | 1.31 |
| 60 | 1.18 | 1.29 | 1.32 |
| 75 | 1.22 | 1.30 | 1.32 |
| 90 | 1.26 | 1.31 | 1.33 |
| 105 | 1.28 | — | 1.33 |
| 120 | 1.31 | — | 1.33 |
| | RAWLINGS ST-5 - B | | |
| 0 | 1.00 | 1.00 | 1.00 |
| 15 | 1.03 | 1.13 | 1.15 |
| 30 | 1.07 | 1.18 | 1.23 |
| 45 | 1.11 | 1.21 | 1.26 |
| 60 | 1.14 | 1.24 | 1.28 |
| 75 | 1.18 | 1.27 | 1.29 |
| 90 | 1.21 | 1.27 | 1.30 |
| 105 | 1.23 | — | 1.31 |
| 120 | 1.26 | — | 1.32 |
| | EXAMPLE 2 | | |
| 0 | 1.00 | 1.00 | 1.00 |
| 15 | 1.14 | 1.09 | 1.08 |
| 30 | 1.21 | 1.16 | 1.14 |
| 45 | 1.25 | 1.20 | 1.18 |
| 60 | 1.27 | 1.22 | 1.20 |
| 75 | 1.29 | 1.24 | 1.22 |
| 90 | 1.30 | 1.25 | 1.23 |
| 105 | — | — | 1.24 |
| 120 | — | — | 1.25 |

As shown in Tables 3 and 4 it is apparent that the RAWLINGS ST-5 balls provide a good deal of water protection in the initial 30–45 minutes of immersion. However, it appears as though the water resistance of the RAWLINGS ball deteriorates dramatically soon thereafter. In subsequent cycles the RAWLINGS balls exhibit none of the initial water resistance of the first 30–45 minutes of the first testing cycle and it appears the RAWLINGS balls absorb water nearly as readily as the untreated WILSON balls.

The Example 2 ball of the present invention provides much better water resistance performance in cycles 2 and 3 than the RAWLINGS or WILSON balls. The tables indicate the ball of the present invention does not loose water resistance through prolonged exposure to water or to repeated cycles of wetting and drying as do balls having a surface water resistance treatment, like the RAWLINGS ST-5 balls.

As will be apparent to persons skilled in the art, various modifications and adaptations of the structure described above will become readily apparent without departure from the spirit and scope of this Invention.

What is claimed:

1. A game ball with moisture resistance properties, said game ball comprising an inflatable bladder, a leather cover having water resistance properties imparted in a tanning process using tanning materials which distribute said water resistance properties throughout said leather of said cover while permitting the passage of water vapor throught the leather; and a lining disposed between said bladder and said cover, said lining in the form of a fiber reinforced continuous sheet of polymer material pressed tightly against the backside of the leather cover by the inflated bladder to form a gasket which can seal the backside of the leather cover against infiltration by water, wherein when said game ball has been immersed for three 45 minute cycles in water at about 70° F. and has been dried between cycles, said ball contains a maximum amount of water as expressed in a ratio of a weight of the football and absorbed water to a weight of the dry football, such ratio being a maximum of 1.2:1.

2. The game ball of claim 1 wherein said game ball is a football.

3. The game ball of claim 1 wherein the amount of water contained after a second cycle expressed as said ratio is no greater than the amount of water contained after a first cycle expressed as said ratio.

4. The game ball of claim 1 wherein the amount of water contained after a third cycle expressed as said ratio is no greater than the amount of water contained after a first cycle expressed as said ratio.

5. The game ball of claim 1 wherein the amount of water contained after a said test cycle expressed as said ratio will be no greater than previous cycles expressed as said ratio.

* * * * *